US009336716B2

(12) United States Patent
Shin et al.

(10) Patent No.: US 9,336,716 B2
(45) Date of Patent: May 10, 2016

(54) ORGANIC LIGHT EMITTING DISPLAY

(71) Applicant: SAMSUNG DISPLAY CO., LTD., Yongin, Gyeonggi-Do (KR)

(72) Inventors: Kwang-Suk Shin, Yongin (KR); Won-Jun Choe, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 24 days.

(21) Appl. No.: 14/072,918

(22) Filed: Nov. 6, 2013

(65) Prior Publication Data

US 2014/0198091 A1 Jul. 17, 2014

(30) Foreign Application Priority Data

Jan. 17, 2013 (KP) ..... 10-2013-0005457

(51) Int. Cl.
*G09G 1/00* (2006.01)
*G09G 3/32* (2016.01)

(52) U.S. Cl.
CPC ..... *G09G 3/3233* (2013.01); *G09G 3/3266* (2013.01); *G09G 3/3291* (2013.01); *G09G 2360/16* (2013.01)

(58) Field of Classification Search
CPC ..... G09G 3/30; G09G 5/36; G09G 5/10; G09G 3/3291
See application file for complete search history.

(56) References Cited

U.S. PATENT DOCUMENTS

| | | | | |
|---|---|---|---|---|
| 2006/0220578 | A1 | 10/2006 | Park et al. | |
| 2012/0038684 | A1 | 2/2012 | Ryu | |
| 2012/0256936 | A1 * | 10/2012 | Lee et al. | 345/549 |
| 2013/0127923 | A1 * | 5/2013 | An et al. | 345/690 |
| 2014/0104258 | A1 * | 4/2014 | Oh et al. | 345/211 |

FOREIGN PATENT DOCUMENTS

| | | | |
|---|---|---|---|
| KR | 10-0629586 | B1 | 9/2006 |
| KR | 10-2012-0014775 | A | 2/2012 |
| KR | 10-2012-0114989 | A1 | 10/2012 |

* cited by examiner

*Primary Examiner* — Michael Faragalla
(74) *Attorney, Agent, or Firm* — Lee & Morse, P.C.

(57) ABSTRACT

An organic light emitting display includes a scan driving unit applying scan signals and light emitting control signals through a plurality of scan lines and light emitting control lines, a data driving unit applying data signals through a plurality of data lines, a power supply supplying an electric power to a plurality of power supply entries, a pixel unit including a plurality of pixels receiving the plurality of scan signals, light emitting control signals, data signals, and the electric power to display an image, the pixel unit being divided into a plurality of regions corresponding to the plurality of power supply entries, and a current limiting circuit using data current values accumulated region by region in the plurality of regions to output current limiting signals for limiting brightness of the pixel unit.

9 Claims, 4 Drawing Sheets

ORGANIC LIGHT EMITTING DISPLAY

CROSS-REFERENCE TO RELATED APPLICATION

This application claims priority to and the benefit of Korean Patent Application No. 10-2013-0005457, filed on Jan. 17, 2013, in the Korean Intellectual Property Office, and entitled: "ORGANIC LIGHT EMITTING DISPLAY," which is incorporated by reference herein in its entirety.

BACKGROUND

1. Field

Embodiments relate to an organic light emitting display.

2. Description of the Related Art

Various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays. Among the FPDs, the organic light emitting displays display images using organic light emitting diodes (OLED) that generate light by re-combination of electrons and holes. The organic light emitting displays have high response speed and exhibit low power consumption.

SUMMARY

Embodiments are directed to an organic light emitting display, including a scan driving unit applying scan signals and light emitting control signals through a plurality of scan lines and light emitting control lines, a data driving unit applying data signals through a plurality of data lines, a power supply supplying an electric power to a plurality of power supply entries, a pixel unit including a plurality of pixels receiving the plurality of scan signals, light emitting control signals, data signals, and the electric power to display an image, the pixel unit being divided into a plurality of regions corresponding to the plurality of power supply entries, and a current limiting circuit using data current values accumulated region by region in the plurality of regions to output current limiting signals for limiting brightness of the pixel unit.

The power supply entries may be arranged at outer upper and lower sides, outer left and right sides, or outer upper, lower, left, and right sides of the pixel unit.

The output current limiting signals may be applied to the data driving unit or the scan driving unit.

The output current limiting signals may be applied to the data driving unit, and the data driving unit may perform gamma compensation on data signals to correspond to the current limiting signals and provide gamma-compensated data signals to the pixel unit.

The output current limiting signals may be applied to the scan driving unit, and the scan driving unit may adjust pulse widths of the light emitting control signals to correspond to the current limiting signals.

The current limiting circuit may include a plurality of data current accumulators accumulating data current values for a single frame output from the pixel unit, a plurality of scale factor generators comparing the accumulated data current values respectively output from the data current accumulators with corresponding threshold values to generate corresponding scale factors, a scale factor selector selecting one of the scale factors generated by the scale factor generators, and a current limiting signal generator generating a current limiting signal corresponding to the selected scale factor.

The plurality of data current accumulators may include a global data current accumulator accumulating data current values for a single frame output from the entire pixel unit, and first region to nth region data current accumulators respectively accumulating data current values output for respective single frames region by region in the plurality of regions.

The plurality of scale factor generators may include a global scale factor generator to which accumulated data current values output from the global data current accumulator are applied, and first region to nth region scale factor generators to which accumulated data current values respectively output from the first region to nth region data current accumulators are applied.

The scale factors generated by the scale factor generators may be values of 0 (zero) to 1 (one).

The scale factor selected by the scale factor selector may be a minimum scale factor of the generated scale factors.

BRIEF DESCRIPTION OF THE DRAWINGS

Features will become apparent to those of skill in the art by describing in detail example embodiments with reference to the attached drawings in which.

DETAILED DESCRIPTION

Figure 1:
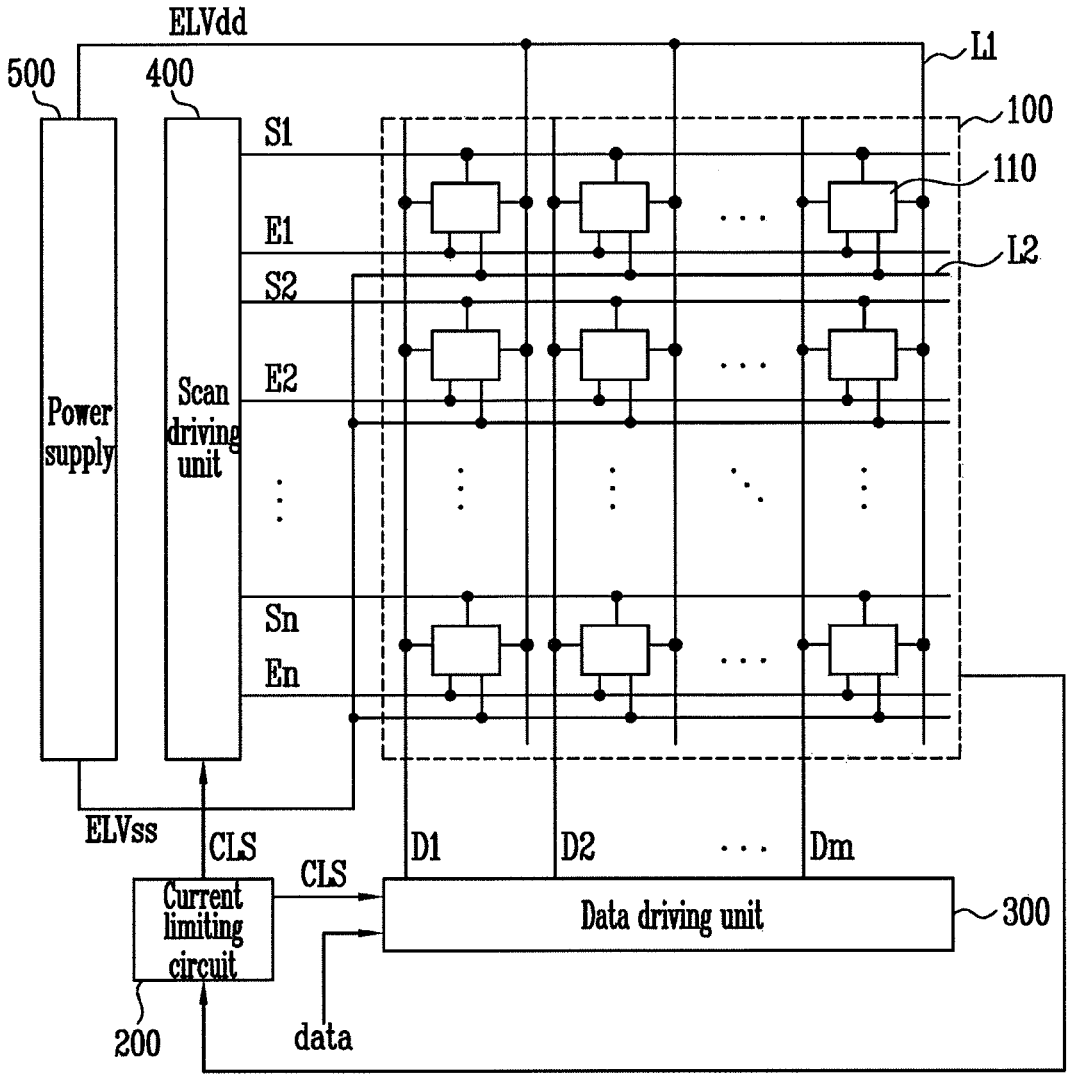
FIG. 1 is a schematic block diagram illustrating an organic light emitting display according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "on" another element, it may be directly on the other element, or one or more intervening elements may also be present. It will also be understood that when an element is referred to as being "under" another element, it may be directly under, or one or more intervening elements may also be present. It will also be understood that when an element is referred to as being "between" two elements, it may be the only element between the two elements, or one or more intervening elements may also be present. Like reference numerals refer to like elements throughout.

FIG. 1 is a schematic block diagram illustrating an organic light emitting display according to an example embodiment.

In the example embodiment shown in FIG. 1, an organic light emitting display according to an example embodiment includes a pixel unit 100, a current limiting circuit 200, a data driving unit 300, a scan driving unit 400, and a power supply 500.

The pixel unit 100 includes n scan lines S1 to Sn formed in a first direction and transmitting scan signals, and includes n light emitting control signal lines E1 to En transmitting light emitting control signals. The pixel unit 100 also includes m data lines D1 to Dm formed in a second direction intersecting with the first direction to transmit data signals; and pixels 110, each of which has an organic light emitting diode and at least two transistors, formed at the intersections between the light emitting control signal lines and the data lines.

In addition, first power lines L1 supplying a first power ELVdd to each of the pixels 110 and second power lines L2 supplying second power ELVss to every pixels are arranged. The first power ELVdd and the second power ELVss are electrically connected to anode electrodes and cathode electrodes of the organic light emitting diodes provided in the pixels 110.

In the present example embodiment, the first and second powers are supplied from the power supply 500 as shown in FIG. 1 wherein the first power ELVdd has a voltage higher than that of the second power ELVss.

In the organic light emitting display according to the present example embodiment, the driving transistors of the respective pixels supply data current of a magnitude corresponding to the data signals of the data lines connected thereto to the organic light emitting diodes, such that the organic light emitting diode emit light to display an image.

In the present example embodiment, the data current flows through current paths formed due to the differences between the first powers and the second powers which are supplied to the anode electrodes and the cathode electrode of the organic light emitting diodes.

In addition, although not depicted in FIG. 1, the first power ELVdd applied from the power supply 500 is supplied to the respective pixels 110 of the pixel unit 100 through the plurality of power supply entries formed in the external region of the pixel unit 100.

Thus, the first power lines L1 are grouped for each of the plurality of the power supply entries to be provided in the pixel unit 100 so that the pixel unit 100 may be divided into a plurality of regions to correspond to the plurality of power supply entries.

Figure 3A:
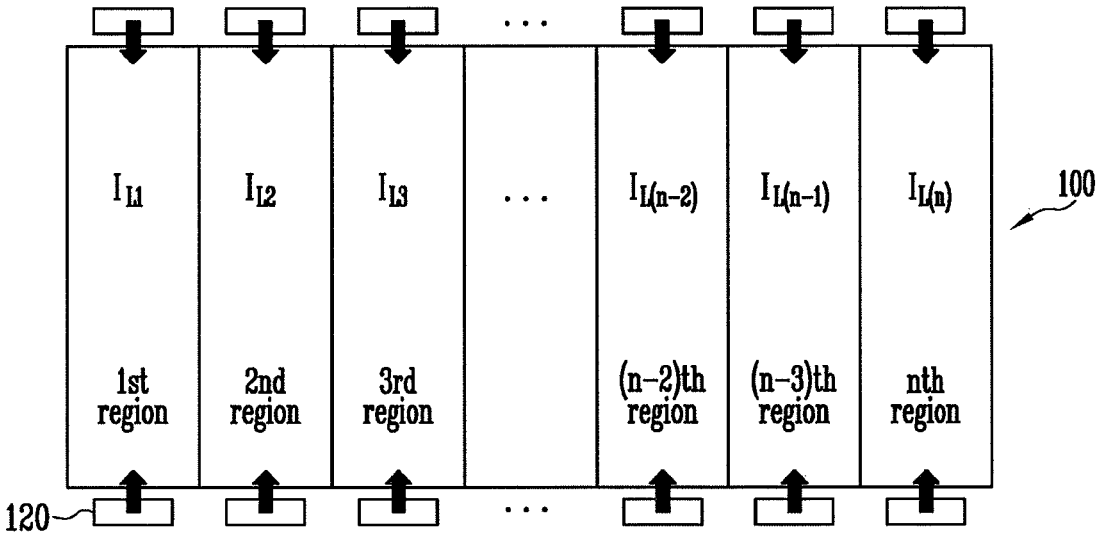
FIGS. 3A to 3C are views illustrating divided regions of a pixel unit according to example embodiments.
Figure 3B:
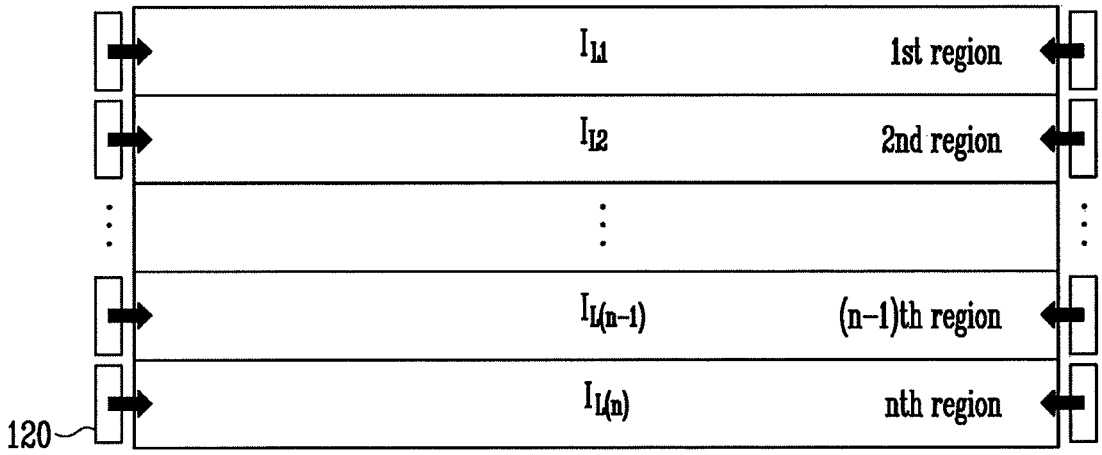
Figure 3C:
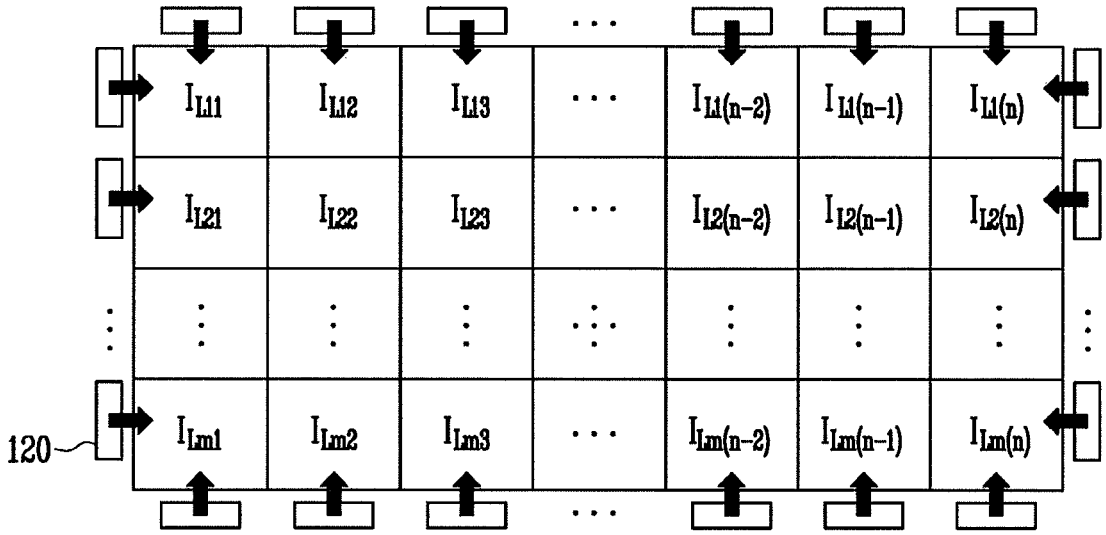

In the present example embodiment, the power supply entries may be disposed at the outer upper and lower sides, the outer right and left sides, or the outer upper, lower, left, and right sides of the pixel unit; example embodiments of said arrangements for the power supply entries are shown, respectively, in FIGS. 3A to 3C.

In addition, the second power lines L2 provided with the second power ELVss are shown equivalently in FIG. 1, and may be integrally formed in whole region of the pixel unit 100 to be electrically connected to the respective pixels 110.

The current limiting circuit 200 plays a role of outputting a current limiting signal to limit the data current accumulated in the whole pixel unit 100 such that brightness of the pixel unit 100 displaying an image does not exceed a predetermined level.

When a large area of the pixel unit 100 displays a high brightness (or high gray) image, there are many pixels in which a large data current is applied to the organic light emitting diodes. In that case, the brightness is higher than that when a small area of the pixel unit 100 displays a high brightness (or high gray) image. For example, the pixel unit 100 has a higher brightness when emitting full white light than in other cases. In this case, a lot of current flows to the pixel unit 100 and a heavy load is applied to the power supply providing the first and second powers, resulting in increasing power consumption.

Accordingly, the current limiting circuit 200 outputs a current limiting signal CLS when the area on which a high brightness (or high gray) image is displayed is large, so as to limit the data current accumulated in the entire pixel unit such that the brightness of the pixel unit 100 does not exceed a predetermined level, and to decrease overall brightness of the image displayed by the pixel unit 100.

In the present example embodiment, the current limiting signal CLS, as illustrated in FIG. 1, may be applied to the data driving unit 300 and/or the scan driving unit 400.

FIG. 1 illustrates the current control signal CLS as being applied to both the data driving unit 300 and the scan driving unit 400; however this is merely an example embodiment and the current limiting signal CLS may be applied to, e.g., only one of the data driving unit 300 and the scan driving unit 400.

In an example embodiment, the current limiting signal CLS is applied to the data driving unit 300 and the data driving unit 300 performs gamma compensation to data signals input thereto in correspondence with the current limiting signal. The data driving unit 300 provides the gamma-compensated data signals to the pixel unit 100.

In another example embodiment, the current limiting signal CLS is applied to the scan driving unit 400 and the scan driving unit 400 adjusts a pulse width of a light emitting control signal to correspond to the current limiting signal. Thus, in a case of a large area on which a high brightness (or high gray) image is displayed, the pulse width of the light emitting control signal is applied shorter than an existing pulse width in correspondence with the current limiting signal CLS, thus decreasing the amount of the data current introduced into the pixel unit 100 to reduce the overall brightness of the pixel unit 100.

The current limiting circuit 200 according to an example embodiment measures the data current accumulated for a single frame in the respective regions of the pixel unit 100, which is divided into a plurality of regions to correspond to the plurality of power supply entries. The current limiting circuit 200 compares the measured data current with predetermined threshold values in the respective region to estimate scale factors SF for the respective regions, and selects one of the estimated scale factors to limit the data current applied to the entire pixel unit such that brightness of an image displayed in the pixel unit 100 is reduced entirely.

The current limiting circuit 200 detects the magnitude of overall data current corresponding to a data signal input for a single frame and at the same time detects magnitude of data current accumulated for a single frame to control brightness of an image. Thus, a case in which a lot of current is applied to pixels only in a specific region and a large current flows to the power supply entries corresponding to the specific region (resulting in heavy heat) when high brightness (high gray) data is applied to only the specific region of the pixel unit 100 may be mitigated.

The data driving unit 300 applies the data signals to the pixel unit 100 and receives video data having Red-, Blue, and Green-components to generate the data signals. The data driving unit 300 is connected to the data lines D1 to Dm of the pixel unit 100 to apply the generated data signals to the pixel unit 100. In the present example embodiment, the data driving unit 300, as described above, may perform the gamma compensation to the data signals input to correspond to the current limiting signals CLS and may provide the compensated data signals to the pixel unit 100.

In addition, the scan driving unit 400 applies the scan signal and the light emitting control signals to the pixel unit 100, and is connected to the scan lines S1 to Sn and the light emitting signal lines E1 to En to transmit the scan signals and the light emitting control signals to a specific column of the pixel unit 100. In the present example embodiment, the scan driving unit 400, as described above, may adjust a pulse width of the light emitting control signal to correspond to the current limiting signal CLS.

The data signals output from the data driving unit 300 are transmitted to the pixels 110 to which the scan signals are transmitted and the pixels 110 emit light according to light emitting control signals.

The scan driving unit 400 may be divided into a scan driving circuit (generating a scan signal) and a light emitting driving circuit (generating the light emitting control signal), wherein the circuits may be included in a single element or may be separated from each other.

The data signals are applied from the data driving unit 300 to a specific column of the pixel unit 100 to which the scan signals are transmitted and current corresponding to the data signals is transmitted to the light emitting device such that an image is displayed by emitting light of the light emitting device. In the present example embodiment, when all columns are sequentially selected, one frame is completed.

Figure 2:
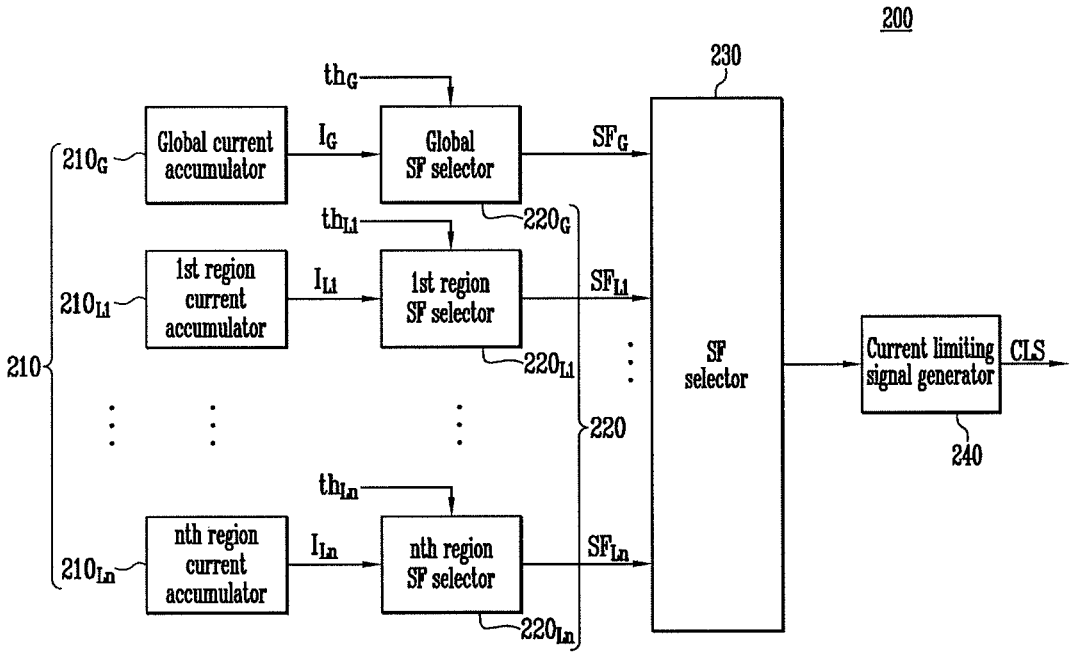
FIG. 2 is a block diagram illustrating a current limiting circuit shown in FIG. 1.

FIG. 2 is a block diagram illustrating a current limiting circuit shown in FIG. 1 and FIGS. 3A to 3C are views illustrating divided regions of a pixel unit according to respective example embodiments.

Referring to FIG. 2, the current limiting circuit 200 according to an example embodiment includes a plurality of data current accumulators 210 accumulating current values for a single frame output from the pixel unit 100. Also, the current limiting circuit 200 includes a plurality of scale factor generators 220 comparing the accumulated data current values $I_G$, $I_{L1}$ to $I_{Ln}$ respectively output from the data current accumulators with threshold values $th_G$, $th_{L1}$ to $th_{Ln}$ corresponding thereto to generate scale factors $SF_G$ and SFL1 to $SF_{Ln}$. Also, the current limiting circuit 200 includes a current limiting signal generator 240 generating the current limiting signals CLS corresponding to the selected minimum scale factor.

In the present example embodiment, the plurality of current accumulators 210, as illustrated in FIG. 2, includes a global current accumulator $\mathbf{210}_G$ accumulating data current $I_G$ for one frame output from the entire pixel unit 100. Also, the plurality of current accumulators 210 includes first to nth data current accumulators $\mathbf{210}_{L1}$ to $\mathbf{210}_{Ln}$ accumulating the data current values $I_{L1}$ to $I_{Ln}$ output for respective single frames each by each of the plurality of regions with respect to the pixel unit 100 that is divided into a plurality of regions to correspond to the plurality of power supply entries.

As described with respect to FIG. 1, the first power ELVdd applied from the power supply 500 is provided to the respective pixels 110 of the pixel unit 100 through the plurality of power supply entries formed at the outside of the pixel unit 100. Thus, the first power ELVdd forms a group for one by one of the plurality of power supply entries to be supplied to the pixel unit 100. The pixel unit 100 may be divided into a plurality of regions to correspond to the plurality of power supply entries.

In the present example embodiment, the power supply entries may be disposed at the outer upper and lower sides, the outer right and left sides, or the outer upper, lower, left, and right sides of the pixel unit 100, as in the example embodiments of arrangements for the power supply entries that are shown, respectively, in FIGS. 3A to 3C.

FIG. 3A illustrates an example embodiment where power supply entries 120 are arranged at the outer upper and lower sides of the pixel unit 100, FIG. 3B illustrates an example embodiment where the power supply entries 120 are arranged at the outer left and right sides of the pixel unit 100, and FIG. 3C illustrates an example embodiment where the power supply entries 120 are arranged at the outer upper, lower, left, and right sides of the pixel unit 100.

In the example embodiment illustrated in FIG. 3C, all the power supply entries 120 are arranged at four sides of the pixel unit 100 so that there are n*m blocks as illustrated, and the data currents accumulated in the respective n*m blocks are compared with the threshold values predetermined block by block so that the scale factors are generated block by block.

The current limiting circuit 200 as shown in FIG. 2 for the illustrative purpose is applied to the embodiment as shown in FIG. 3A, but embodiments are not limited thereto.

As illustrated in FIG. 2, when the data current accumulator 210 includes a global data current accumulator $\mathbf{210}_G$ and first to nth region data current accumulators $\mathbf{210}_{L1}$ to $\mathbf{210}_{Ln}$, the plurality of scale factor generators 220 includes a global scale factor generator $\mathbf{220}_G$ and first to nth region scale factor generators $\mathbf{220}_{L1}$ to $\mathbf{220}_{Ln}$ to match the data current accumulators.

The scale factor generators $\mathbf{220}_G$ and $\mathbf{220}_{L1}$ to $\mathbf{220}_{Ln}$ compare the accumulated data current values $I_G$ and $I_{L1}$ to $I_{Ln}$ respectively output from the respective data current accumulators $\mathbf{210}_G$ and $\mathbf{210}_{L1}$ to $\mathbf{210}_{Ln}$ with the corresponding threshold values $th_G$ and $th_{L1}$ to $th_{Ln}$, and generate the scale factors SF corresponding to the same.

In the present example embodiment, the threshold values are predetermined values which are determined by changing data applied to the power supply entries to determine data in which temperatures of the entries do not exceed a target temperature, and setting data current accumulated values for the determined data as the threshold values for the respective regions. Thus, the threshold values may differ region by region.

In addition, the scale factors generated by the scale factor generator 220 are values of 0 (zero) to 1 (one) and values of the generated scale factors corresponding to the regions becomes small. Thus, the scale factors are close to 0 (zero).

For example, when the data current accumulated value output from the nth data current accumulator $\mathbf{210}_{Ln}$ is greater than a corresponding threshold value $th_{Ln}$, the scale factor generated by the nth region scale factor generator $\mathbf{220}_{Ln}$ has a value close to 0 (zero).

In this manner, the plurality of scale factor generators $\mathbf{220}_G$ and $\mathbf{220}_{L1}$ to $\mathbf{220}_{Ln}$ respectively generate the scale factors $SF_G$ and $SF_{L1}$ to $SF_{Ln}$ corresponding to the entire pixel unit and the respective regions, and the current limiting signal generator 240 selects the minimum value from the scale factors $SF_G$ and $SF_{L1}$ to $SF_{Ln}$ and generates corresponding current limiting signals CLS to output.

The current limiting signals CLS are applied to the data driving unit 300 to perform the gamma compensation of the data signals input from the outside and to provide the compensated data signals to the pixel unit 100, and/or are applied to the scan driving unit 400 to adjust the pulse widths of the light emitting control signals.

Thus, when high brightness (high gray) data is applied to only a specific region of the pixel unit 100, a case in which a lot of current is applied to pixels only in the specific region and a large current flows to the entries of the power supply corresponding to the specific region resulting in heavy heat may be mitigated.

Heating of the power supply entries may be affected by the data current accumulated value of a corresponding region and a data current accumulated value of an adjacent region. In another example embodiment, weights are respectively set to a corresponding region and ambient regions adjacent thereto so that the data current accumulated values may be estimated. For example, in a case when a data current accumulated value in a third region, data current accumulated values in a second region and a fourth region as the most adjacent regions, and a first region and a fifth region as the next most adjacent regions may be reflected. Thus, a weight a is applied to the third region, a weight b is applied to the second and fourth regions, and a weight c is applied to the first and fifth regions so that the data current value accumulated in the third region may be estimated as $I_{L3}'=aI_{L3}+b(I_{L2}+I_{L4})+c(I_{L1}+I_{L5})$. However, a, b, and c are integers, a+b+c=1, and the condition a>b>c is satisfied.

The scale factor generation using the data current accumulated region by region that are estimated by the above-mentioned estimation is identical to those described with respect to FIG. 2.

By way of summation and review, an organic light emitting display device includes a pixel unit having a plurality of data lines and scan lines, and a plurality of pixels formed in intersections between the data lines and the scan lines. Each pixel may include an organic light emitting diode and a driving transistor. In addition, the pixel unit is applied with a first power and a second power to supply a predetermined voltage to anode electrodes and cathode electrodes of the organic light emitting diodes, which are provided in the respective pixels.

The organic light emitting display may display a predetermined image by which the driving transistors included in the respective pixels supply data current of a magnitude corresponding to data signals of the data lines connected to the driving transistors and due to this the organic light emitting diodes generate light. The data current flows through a current path formed due to a voltage difference between the first and second powers that are supplied to the anode electrodes and the cathode electrodes of the organic light emitting diode.

A lot of current may flow to the organic light emitting diodes of the respective pixels forming the pixel unit when the organic light emitting display displays a high brightness (or high gray) image, while a small quantity of current may flow to the organic light emitting diodes of the respective pixels when a low brightness (or low gray) image is displayed. In a case where a high brightness (or high gray) image is displayed, a lot of current may flow to the pixel unit and a lot of load may be applied to a power supply for supplying the first and second powers so that power consumption may increase.

To address such power consumption, a method of limiting current flowing through whole pixel unit may be used in which the current is measured and the measured current is checked to see if it is higher than a threshold value. However, in such a method, overall current of the pixel unit may be less than the threshold value when high brightness (or high gray) data is applied only to a specific region of the pixel unit. Thus, the current may not be limited, and a lot of current may be applied to only pixels of a specific region such that a large current may flow to a power supply entry resulting in significant heat.

As described above, embodiments may provide an organic light emitting display including a plurality of power supply entries for applying electric power supplied from a power supply to a pixel unit. The pixel unit may have a plurality of regions defined to correspond to the plurality of power supply entries. Data current accumulated in each of the plurality of regions may be measured. The measured data current may be compared with threshold values set region by region to estimate a scale factor region by region. The data current applied to the entire pixel unit may be limited by selecting one of the estimated scale factors. Thus, it may be possible to reduce or avoid large amounts of heat caused by a large current flowing the power supply entries when high brightness (or high gray) data is applied only to a specific region of the pixel unit.

According to embodiments, when a large data current concentrates on a specific region of a pixel unit in which a plurality of regions are defined, the data current applied to the pixel unit may be limited by sensing this phenomenon so that the power supply entry corresponding to the specific region may be prevented from being overheated.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An organic light emitting display, comprising:

a scan driver to apply scan signals and light emitting control signals through a plurality of scan lines and light emitting control lines;

a data driver to apply data signals through a plurality of data lines;

a power supply to supply electric power to a plurality of power supply entries;

a pixel unit including a plurality of pixels to receive the plurality of scan signals, light emitting control signals, data signals, and the electric power to display an image, the pixel unit being divided into a plurality of regions corresponding to the plurality of power supply entries; and a current limiting circuit to output current limiting signals, based on the data current values accumulated region by region in the plurality of regions, to at least one of the scan driver or the data driver to limit brightness of the pixel unit.

2. The organic light emitting display as claimed in claim 1, wherein the power supply entries are arranged at outer upper and lower sides, outer left and right sides, or outer upper, lower, left, and right sides of the pixel unit.

3. The organic light emitting display as claimed in claim 1, wherein the output current limiting signals are applied to the data driver, and the data driver is to perform gamma compensation on data signals to correspond to the current limiting signals and provide gamma-compensated data signals to the pixel unit.

4. The organic light emitting display as claimed in claim 1, wherein the output current limiting signals are applied to the scan driver, and the scan driver adjusts pulse widths of the light emitting control signals to correspond to the current limiting signals.

5. The organic light emitting display as claimed in claim 1, wherein the current limiting circuit includes:

a plurality of data current to accumulate accumulating data current values for a single frame output from the pixel unit;

a plurality of scale factor generators to compare the accumulated data current values respectively output from the data current accumulators with corresponding threshold values to generate corresponding scale factors;

a scale factor selector to select one of the scale factors generated by the scale factor generators; and a current limiting signal generator to generate a current limiting signal corresponding to the selected scale factor.

6. The organic light emitting display as claimed in claim 5, wherein the plurality of data current accumulators includes:

a global data current accumulator to accumulate data current values for a single frame output from the entire pixel unit; and first region to nth region data current accumulators to respectively accumulate data current values output for respective single frames region by region in the plurality of regions.

7. The organic light emitting display as claimed in claim 6, wherein the plurality of scale factor generators includes:

a global scale factor generator to receive accumulated data current values output from the global data current accumulator; and first region to nth region scale factor generators to receive accumulated data current values respectively output from the first region to nth region data current accumulators.

8. The organic light emitting display as claimed in claim 5, wherein the scale factors generated by the scale factor generators are values of 0 (zero) to 1 (one).

9. The organic light emitting display as claimed in claim 5, wherein the scale factor selected by the scale factor selector is a minimum scale factor of the generated scale factors.

* * * * *